US006339923B1

(12) United States Patent
Halila et al.

(10) Patent No.: US 6,339,923 B1
(45) Date of Patent: Jan. 22, 2002

(54) FUEL AIR MIXER FOR A RADIAL DOME IN A GAS TURBINE ENGINE COMBUSTOR

(75) Inventors: Ely E. Halila; Stuart C. Greenfield, both of Cincinnati, OH (US); Paul V. Heberling, Lawrenceburg, IN (US); John D. Bibler, Mason; John A. Kastl, Lebanon, both of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/398,559

(22) Filed: Sep. 17, 1999

Related U.S. Application Data

(60) Provisional application No. 60/103,652, filed on Oct. 9, 1998, and provisional application No. 60/103,649, filed on Oct. 9, 1998.

(51) Int. Cl.[7] ..... F23R 3/30
(52) U.S. Cl. ..... 60/37.31; 60/738
(58) Field of Search ..... 60/39.31, 737, 60/738, 740, 748

(56) References Cited

U.S. PATENT DOCUMENTS

| | | | | |
|---|---|---|---|---|
| 3,403,511 A | | 10/1968 | Jaekel et al. | 60/39.82 |
| 3,531,937 A | * | 10/1970 | Sneeden | 60/738 |
| 4,466,250 A | * | 8/1984 | Mukaeda | 60/737 |
| 5,444,982 A | | 8/1995 | Heberling et al. | 60/737 |
| 5,540,056 A | | 7/1996 | Heberling et al. | 60/737 |
| 5,596,873 A | | 1/1997 | Joshi et al. | 60/738 |
| 5,611,196 A | * | 3/1997 | Wilson | 60/737 |
| 5,619,855 A | | 4/1997 | Burrus | 60/736 |
| 5,791,148 A | | 8/1998 | Burrus | 60/752 |
| 5,816,041 A | | 10/1998 | Greninger | 60/39.05 |

FOREIGN PATENT DOCUMENTS

| | | |
|---|---|---|
| EP | 893650 A2 | 1/1999 |
| FR | 788642 | 11/1935 |

OTHER PUBLICATIONS

"HSCT Computer Model Takes Shape ar NASA," pp. 68–76, by James Ott, Hampton VA, in Aviation Week & Space Technology, Oct. 13, 1997.

* cited by examiner

*Primary Examiner*—Louis J. Casaregola
(74) *Attorney, Agent, or Firm*—Andrew C. Hess; Rodney M. Young

(57) ABSTRACT

A fuel air mixer for a gas turbine engine combustor having a longitudinal axis therethrough, wherein the fuel air mixer is configured for use in a dome oriented substantially radial to the longitudinal axis. The fuel air mixer includes a fuel injection assembly having a first end, a second end, a fuel passage extending therethrough, and a flange portion having a plurality of spaced openings formed therein which extends from the first end. The fuel air mixer also includes a mixer assembly having a first end, a second end, a cavity formed in a central portion thereof, and a flange portion having a plurality of spaced openings formed therein which extends from the first end. The mixer assembly is configured to receive the fuel injection assembly in the cavity so that the fuel injection assembly and the mixer assembly are able to be connected to an outer casing of the combustor by means of the respective flange portions.

12 Claims, 5 Drawing Sheets

FUEL AIR MIXER FOR A RADIAL DOME IN A GAS TURBINE ENGINE COMBUSTOR

CROSS-REFERENCE TO RELATED APPLICATIONS

This application is related to provisional applications having Ser. No. 60/103,652 filed Oct. 9, 1998 and Ser. No. 60/103,649, filed Oct. 10, 1998.

STATEMENT REGARDING FEDERALLY SPONSORED RESEARCH AND DEVELOPMENT

The U.S. Government may have certain rights in this invention pursuant to contract number NAS3-27235, NAS3-26617, and/or NAS3-25951.

BACKGROUND OF THE INVENTION

The present invention relates generally to combustors in gas turbine engines and, in particular, to a fuel air mixer configured for use in a dome of a gas turbine engine combustor oriented substantially perpendicular to a longitudinal axis through the combustor.

It will be appreciated that emissions are a primary concern in the operation of gas turbine engines, particularly with respect to the impact on the ozone layer by nitrous oxides (NOx), carbon monoxide (CO), and hydrocarbons. In the case of supersonic commercial transport aircraft flying at high altitudes, current subsonic aircraft technology is not applicable given the detrimental effects on the stratospheric ozone. Accordingly, new fuel injection and mixing techniques have been and continue to be developed in order to provide ultra-low NOx at all engine operating conditions.

In response to such emissions concerns, a new combustor has been developed and is discussed in a patent application entitled "Multi-Stage Radial Axial Gas Turbine Engine Combustor,"which is filed concurrently herewith by the assignee of the present invention, has Ser. No. 09/898,557, and is hereby incorporated by reference. A key component found to provide extremely low levels of NOx at moderate to high power conditions for such aircraft engine was the use of a series of simple mixing tubes as the main fuel injection source. It was found, however, that flame stability and emissions characteristics of a combustor incorporating only such mixing tubes was less capable at low power. Thus, it was determined that an independent pilot fuel injector system would be beneficial for such combustor to improve low power flame stability and meet landing-takeoff (LTO) and idle cycle emissions requirements.

The use of combustion staging has been in practice within the gas turbine engine art for many years to expand the operational range of combustion systems, as well as to provide a broad range of gas turbine power output and applicability. This has typically been accomplished by staging the fuel in a plurality of fuel air mixing devices or modulating the mixing devices independently. In addition, air staging has been performed by having separate and/or isolated annular or cannular combustion zones that can be controlled independently to provide low emissions and a broad range of operation. To date, however, such staging by pilot and main combustion zones has been within substantially the same annular plane.

In light of the foregoing, it would be desirable for a fuel air mixer to be developed which is configured for use in a dome oriented substantially perpendicular to a longitudinal axis through the combustor. It would also be desirable for such fuel a air mixer to be constructed so as to employ a cooling scheme which also improves fuel/air mixing and assists in lowering the fuel-air ratio of the premixture provided to the combustion region of such dome.

BRIEF SUMMARY OF THE INVENTION

In an exemplary embodiment of the invention, a fuel air mixer for a gas turbine engine combustor having a longitudinal axis therethrough is disclosed, wherein the fuel air mixer is configured for use in a dome oriented substantially radial to the longitudinal axis. The fuel air mixer includes a fuel injection assembly having a first end, a second end, a fuel passage extending therethrough, and a flange portion having a plurality of spaced openings formed therein which extends from the first end. The fuel air mixer also includes a first end, a second end, a cavity formed in a central portion thereof, and a flange portion having a plurality of spaced openings formed therein which extends from the first end. The mixer assembly is configured to receive the fuel injection assembly in the cavity so that the fuel injection assembly and the mixer assembly are able to be connected to an outer casing of the combustor by means of the respective flange portions.

DETAILED DESCRIPTION OF THE INVENTION

Figure 1:
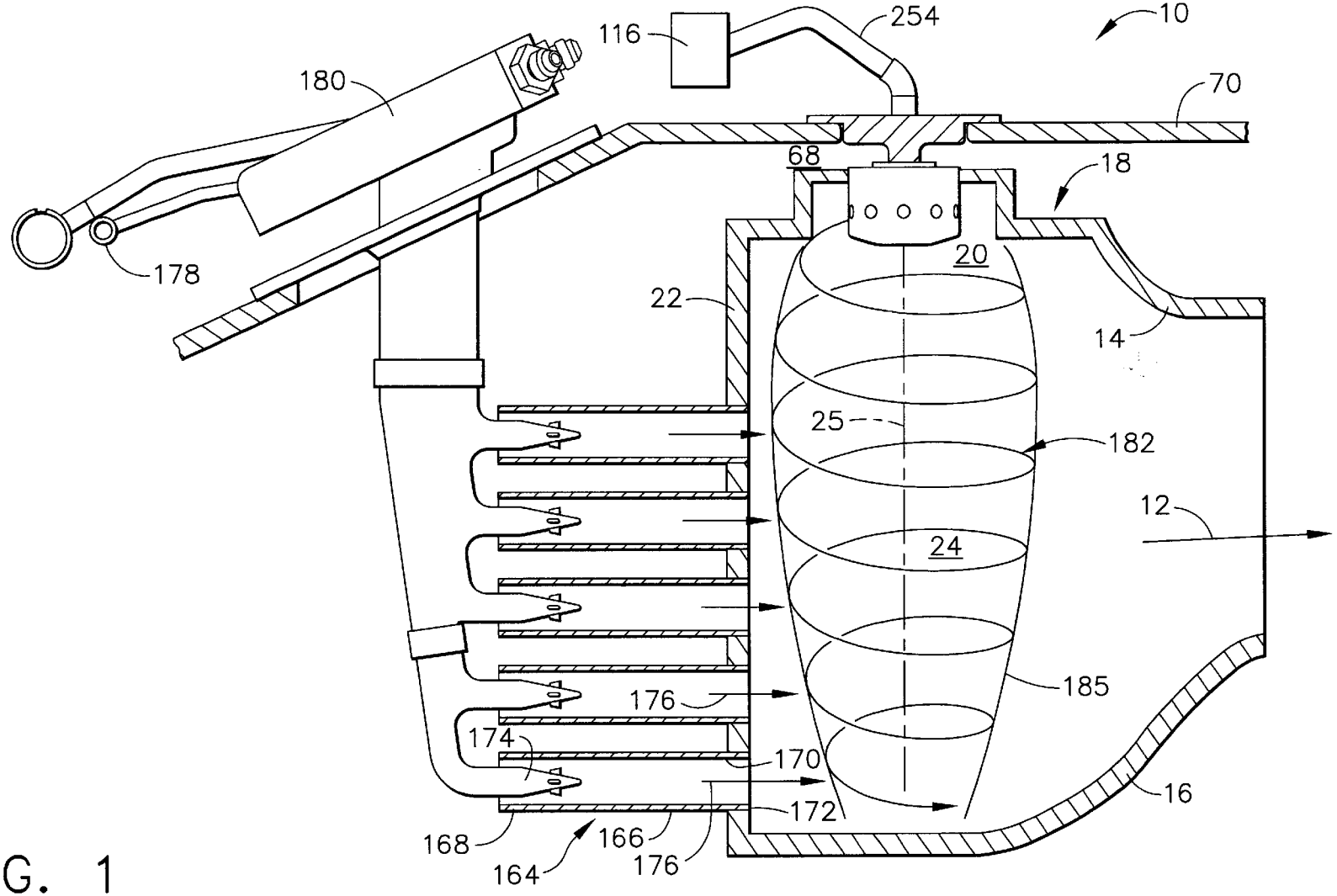
FIG. 1 is a schematic longitudinal cross-sectional view of a gas turbine engine combustor including a fuel air mixer in accordance with the present invention.
Figure 2:
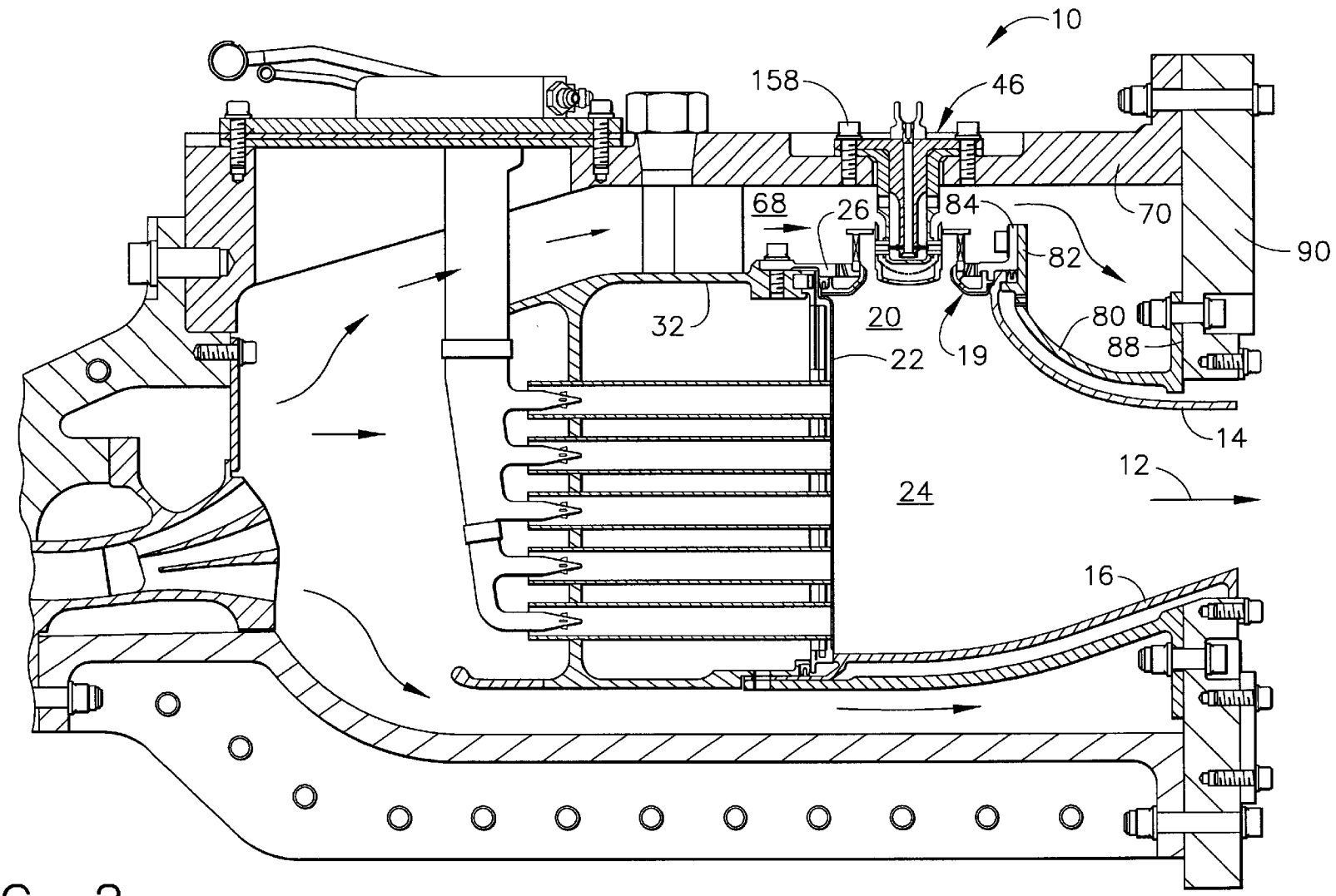
FIG. 2 is a detailed longitudinal cross-sectional view of the multi-stage radial axial combustor depicted in FIG. 1 including a fuel air mixer positioned in the radial dome in accordance with the present invention.

Referring now to the drawings in detail, wherein identical numerals indicate the same elements throughout the figures, FIGS. 1 and 2 depict a gas turbine engine combustor identified generally by reference numeral 10. As seen therein, combustor 10 has a longitudinal axis 12 extending therethrough and includes an outer liner 14, an inner liner 16, a first or pilot dome 18 positioned immediately upstream of outer liner 14 to form a first combustion zone 20 radially oriented to longitudinal axis 12, and a dome plate 22 which is connected to first dome 18 at an outer portion and to inner liner 16 at an inner portion. In this way, a second or main combustion zone 24 is defined by dome plate 22, outer liner 14 and inner liner 16 which is located substantially perpendicular to first combustion zone 20. This combustor design is known as a multi-stage radial axial (MRA) and is discussed in greater detail in the 557 patent application entitled "Multi-Stage Radial Axial Gas Turbine Engine Combustor," incorporated hereinabove by reference.

As indicated in the 557 patent application, fuel air mixers 46 are provided within each impingement baffle opening 28 so as to be aligned along an axis 25 of each segment 19 for first dome 18. Although other configurations of fuel air mixers may be utilized, it is preferred that fuel air mixers 46 have a design similar to the cyclone mixers disclosed in U.S.

Pat. Nos. 5,540,056 and 5,444,982, which are hereby incorporated by reference. It will be understood, however, that certain improvements to the cyclone design are discussed herein, particularly with regard to its application in a radial dome configuration.

Figure 3:
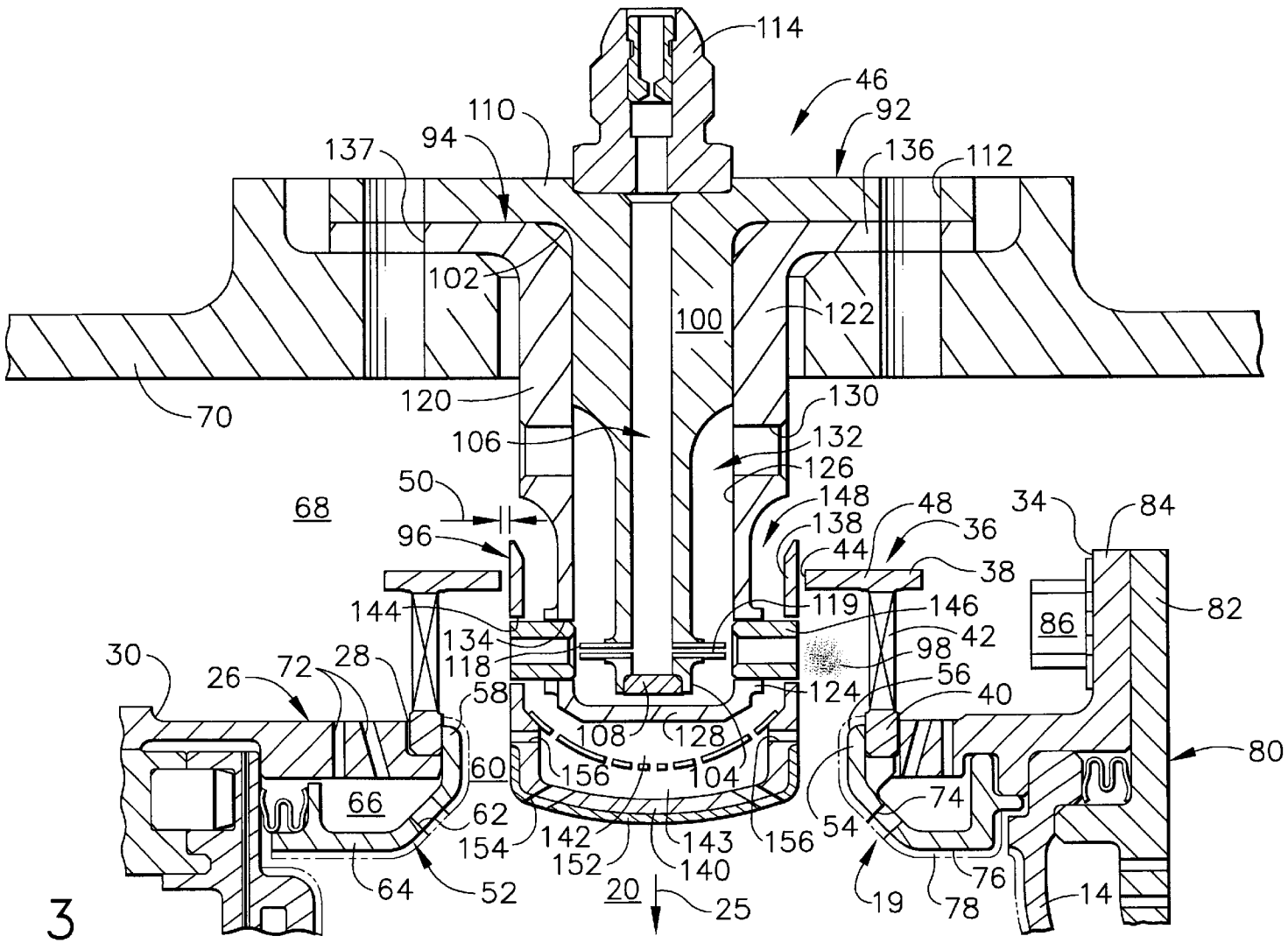
FIG. 3 is an enlarged, cross-sectional view of the radial dome and fuel air mixer depicted in FIGS. 1 and 2.
Figure 4:
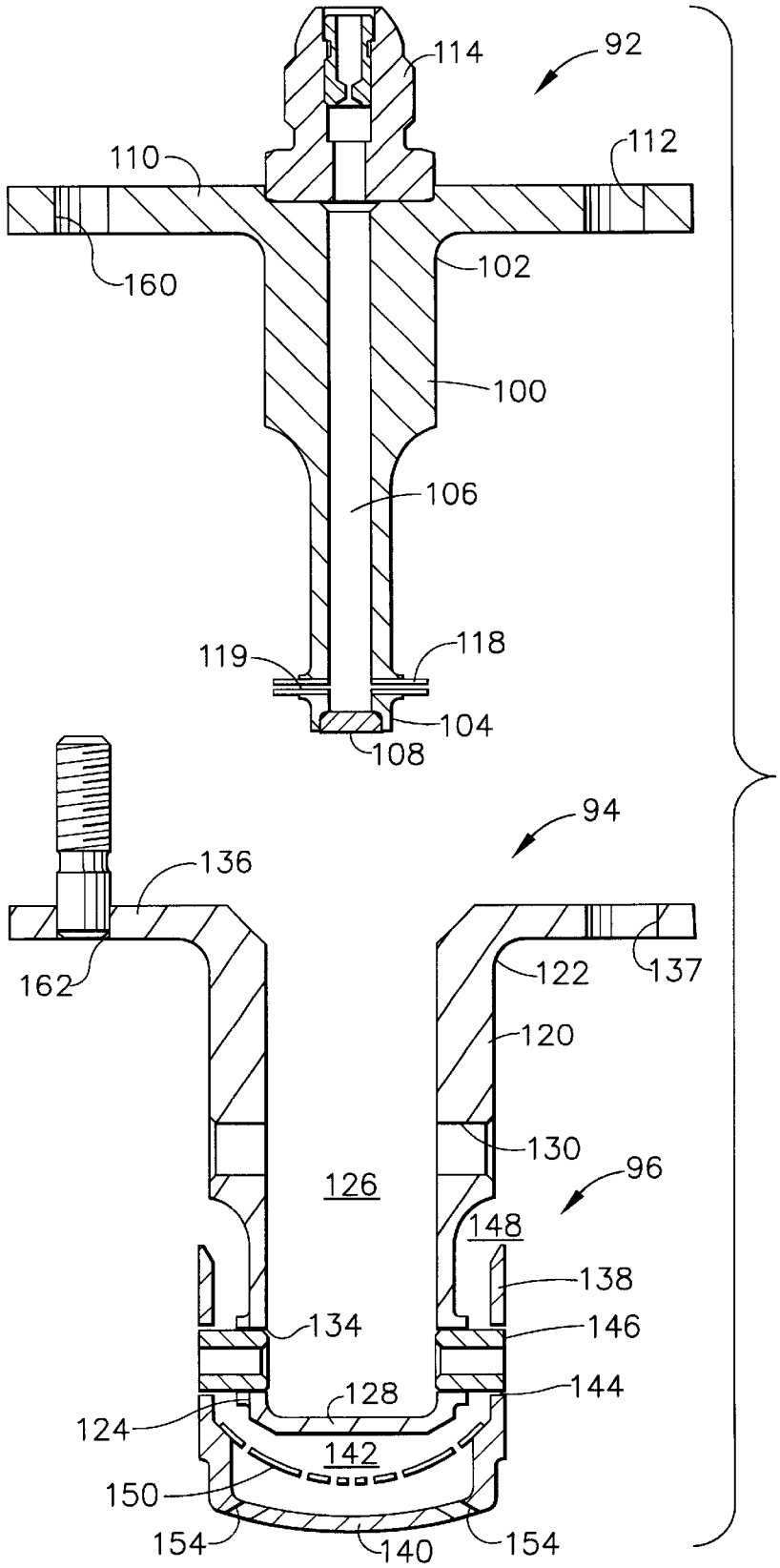
FIG. 4 is an exploded view of the fuel air mixer depicted in FIGS. 2 and 3; and, FIG. 5 is a top view of the fuel air mixer depicted in FIG. 4.
Figure 5:
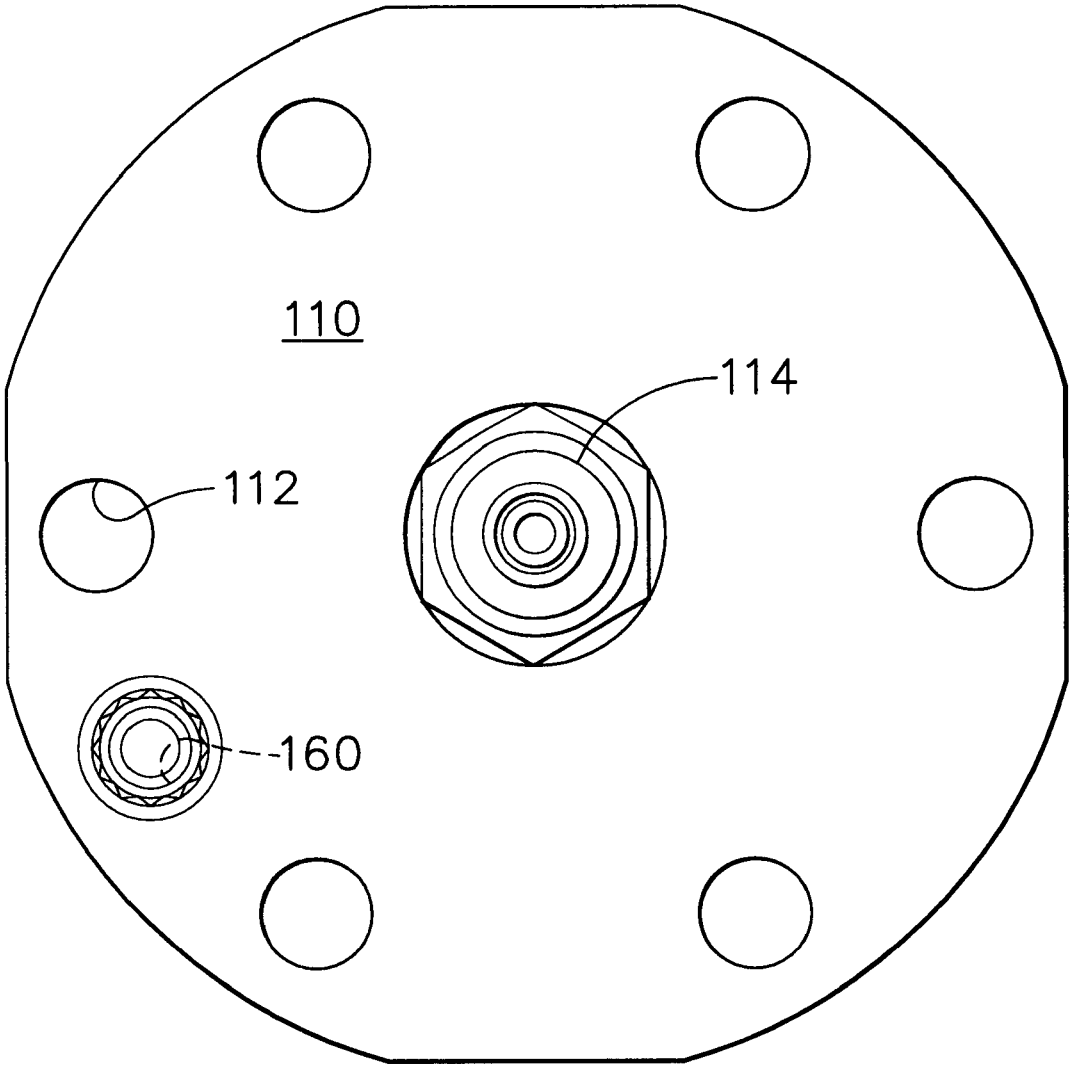

It will be seen from FIGS. 3 and 4 that fuel air mixer 46 preferably includes a fuel injection assembly 92, a mixer assembly 94, and a heat shield 96 which work in concert to provide a fuel air mixture 98 to first dome 18 while maintaining desired air flow therefrom to assist in cooling and preventing boundary conditions from forming. More specifically, fuel injection assembly 92 includes an elongated fuel stem 100 which extends along axis 25 from a first end 102 to a second end 104 and has a passage 106 therein. It will be noted that the diameter of fuel stem 100 is reduced at about a midpoint thereof to second end 104, where an end wall 108 is provided adjacent second end 104 so as to terminate passage 106. Further, a flange portion 110 extends radially outward from axis 25 adjacent first end 102 thereof and includes a plurality of openings 112 therein. A fuel inlet 114 is provided adjacent first end 102 of fuel stem 100 which is in flow communication with passage 106. It will be understood from FIG. 1 that fuel inlet 114 is connected to a fuel supply 116. A plurality of fuel injectors 118 are positioned within corresponding radial openings 119 located adjacent second end 104 of fuel stem 100, wherein fuel injectors 118 are in flow communication with passage 106. Accordingly, fuel enters fuel air mixer 46 at fuel inlet 114, flows through passage 106 until it is injected radially through fuel injectors 118, is mixed with an air flow through swirlers 42, and provided to first dome 18 as premixture 98.

Mixer assembly 94 includes an elongated mixer tube 120 which extends from a first end 122 to a second end 124 and forms a cavity 126 in conjunction with an end wall 128. It will be appreciated that mixer tube 120 is preferably configured so that cavity 126 is able to receive a majority of fuel stem 100 therein. Further, a first plurality of openings 130 are formed in mixer tube 120 approximately midway the length thereof for receiving air flow supplied to outer annular passageway 68. Openings 130 are in flow communication with an annular passage 132 formed by fuel stem 100 and mixer tube 120 which supplies air to the fuel injected by fuel injectors 118. Of course, a second plurality of openings 134 are provided in mixer tube 120 adjacent second end 124 thereof, where such openings 134 are aligned with fuel injectors 118 when fuel stem 100 is positioned in mixer tube 120. It will further be seen that a flange portion 136 extends radially out from mixer tube 120 adjacent first end 122 and is configured so that fuel stem flange portion 110 lies in substantially abutting relation therewith. A plurality of openings 137 are provided in flange portion 136 which may be aligned with openings 112 in fuel stem flange portion 110.

Heat shield 96 is preferably attached to a lower portion of mixer tube 120 and includes a substantially annular wall 138 with an end wall 140 located across a bottom of annular wall 138 so as to form a cavity 142 therein. It will be seen in FIGS. 3 and 4 that a plurality of openings 144 are formed therein in a position so that they align with second openings 134 of mixer tube 120. Heat shield 96 and mixer tube 120 are then preferably connected by means of a plurality of tubes 146 inserted through openings 134 and 144. Tubes 146 are then brazed to heat shield openings 144, but left to form a slip joint with mixer tube openings 134 to allow for movement of mixer tube 120. It will be appreciated that tubes 146 are positioned so as to align with fuel injectors 118, and although not shown, fuel injectors 118 may be positioned within tubes 146. Air entering through openings 130 and traveling down annular passage 132 then exits through tubes 146 and mixes with the fuel provided by injectors 118.

A flow passage 148 is formed by annular wall 138 of heat shield 96 and a portion of mixer tube 120, where flow passage 148 is in flow communication with air flow provided to outer annular passageway 68 so as to provide air to cavity 142. An impingement baffle 150 is preferably provided within cavity 142 so as to meter the air flow to end wall 140. In this way, the air flow into cavity 142 is able to assist in cooling heat shield end wall 140, although end wall 140 preferably includes a thermal barrier coating applied thereto as indicated by reference numeral 152. It will also be seen that a plurality of openings 154 are formed in end wall 140 to release spent cooling air from a cavity 143 in flow communication with cavity 142. The spent cooling air is injected into first combustion zone 20, where it improves mixing, helps prevent flashback into throat area 60, and further lowers the fuel-air ratio of premixture 98 entering first combustion zone 20. Additional openings 156 may be provided within a portion of annular wall 138 (preferably below impingement baffle 150) so as to improve fuel/air mixing through throat area 60.

In order for fuel air mixers 46 to be properly aligned with each impingement baffle opening 28, they are preferably connected to outer casing 70 by means of a mechanical connection with flange portions 110 and 136 of fuel stem 100 and mixer tube 120, respectively. This is accomplished by means of bolts 158 or other similar devices provided in the aforementioned plurality of openings 112 and 137 formed in flange portions 110 and 136. In this way, fuel air mixers 46 may be removed for a maintenance purposes without teardown of combustor 10. Because openings 112 and 137 are typically provided in symmetrical relation about their respective flange portions, an additional opening 160 and 162 is formed in flange portions 110 and 136 so as to ensure proper alignment and orientation of openings 134 and fuel injectors 118 (see FIG. 4). Alternatively, fuel stem 100 and mixer tube 120 may be manufactured with the same number of bolt openings as openings 134 and fuel injectors 118, and be positioned in the same respective circumferential locations. In any event, the connection of flanges 110 and 136 (apart from combustor casing 70) by a mechanical connection through additional openings 160 and 162 permits fuel air mixers 46 to be removed as a whole (as opposed to fuel injection assembly 92 and mixer assembly 94 separately) from combustor 10 after bolts 158 have been removed.

It will also be appreciated that fuel air mixers 46 are sized with respect to a swirler assembly 36 positioned in each baffle opening 28 so as to permit a minimal gap 50 (see FIG. 3) between fuel air mixers 46 and an outer ring portion 38 thereof. Gap 50 not only accounts for thermal growth of outer ring portion 38 and fuel air mixer 46, but movement of first dome 18 relative to outer casing 70. Gap 50 also allows air to be injected therethrough which assists in blowing out a recirculation zone bounded by swirler assembly 36 and fuel air mixer 46.

In operation, fuel air mixer 46 receives fuel through fuel inlet 114 from a pilot supply tube 254 in flow communication with fuel supply 116 (shown in FIG. 1), enters passage 106 in fuel stem 100, and exits passage 106 by injection through fuel injectors 118. The fuel is mixed with air supplied from outer annular passageway 68, which enters annular passage 132 via first mixer tube openings 130. A fuel air mixture 98 is then injected through tubes 146 connecting openings 134 and 144 in mixer tube 120 and heat shield 96, respectively. Fuel air mixture 98 is swirled by air flowing through swirlers 42 and rotationally flows through throat area 60 into first combustion region 20. Of course, fuel air mixture 98 is also influenced by air flowing through openings 154 and 156 in heat shield end wall 140 and heat shield annular wall 138, as well as liner segment openings 74. With respect to the former, it is seen that air is provided by means of a flow passage 148, which is in flow communication with air flow in outer annular passageway 68 and heat shield cavities 142 and 143. Thus, it will be appreciated that fuel air mixer 46 has a dual air flow circuit therethrough.

Having shown and described the preferred embodiment of the present invention, further adaptations of the fuel air mixer for a radial combustor dome can be accomplished by appropriate modifications by one of ordinary skill in the art without departing from the scope of the invention.

What is claimed is:

1. A fuel air mixer for a gas turbine engine combustor having a longitudinal axis therethrough, comprising:

(a) a fuel injection assembly having a first end, a second end, a fuel passage extending therethrough, and a flange portion having a plurality of spaced openings formed therein which extends from said first end, said fuel injection assembly further comprising:

(1) an elongated fuel stem extending from said first end to said second end, said fuel stem including said fuel passage from said first end to said second end;

(2) a fuel inlet in flow communication with said fuel passage in said fuel stem adjacent said first end thereof; and (3) a plurality of fuel injectors in flow communication with said fuel passage in said fuel stem adjacent said second end thereof;

wherein fuel entering said fuel air mixture at said fuel inlet is provided through said fuel stem passage and injected into a combustion zone through said fuel injectors; and (b) a mixture assembly having a first end, a second end, a cavity formed in a central portion thereof, and a flange portion having a plurality of spaced openings formed therein which extends from said first end;

wherein said mixer assembly is configured to receive said fuel injection assembly in said cavity so that said fuel injection assembly and said mixture assembly are able to be connected to a casing of said combustor by means of said flange portions.

2. The fuel air mixer of claim 1, said mixer assembly further comprising:

(a) an elongated mixer tube having a cavity extending from said first end to said second end, said mixer tube including a plurality of first openings formed therein in flow communication with an air supply to an outer annular portion of said combustor and a plurality of second openings formed therein adjacent said second end thereof so as to be alignable with said fuel injectors; and (b) an end wall extending across said a lower portion of said cavity adjacent said second end.

3. The fuel air mixer of claim 2, wherein said fuel stem has a lower portion with a reduced diameter so as to form a passage with said mixer tube which is in flow communication with said mixer tube first openings and enables air to be mixed with fuel as it is injected through said mixer tube second openings.

4. The fuel air mixer of claim 2, said flange portions of said fuel injection assembly and said mixer assembly each including an additional opening formed therein so as to ensure proper alignment and orientation of said fuel injectors and said mixer assembly second openings when aligned and coupled.

5. The fuel air mixer of claim 2, said fuel mixer further comprising a heat shield attached to a lower portion of said mixer assembly.

6. The fuel air mixer of claim 5, said heat shield further comprising:

(a) a substantially annular wall portion configured so as to receive a lower portion of said mixer tube, said annular wall portion of said heat shield including a plurality of openings formed therein and configured so as to be alignable with said second openings in said mixer tube; and (b) an end wall across a lower end of said annular wall portion;

wherein said heat shield and said mixer assembly are connected by means of a tube inserted through each said mixer assembly second opening and said heat shield openings so as to form a cavity between said mixer end wall and said heat shield end wall.

7. The fuel air mixer of claim 6, wherein said tubes are connected only to said heat shield openings so that a slip joint is formed by said tubes and said mixer tube second openings to accommodate transverse movement of said mixer tube.

8. The fuel air mixer of claim 6, wherein said heat shield and said mixer tube are configured so as to form an air flow passage therebetween which is in flow communication with said cavity.

9. The fuel air mixer of claim 6, wherein said heat shield end wall is provided with thermal barrier coating.

10. The fuel air mixer of claim 6, wherein said heat shield end wall includes a plurality of openings formed therein so that air flowing into said cavity is directed into said combustion zone.

11. The fuel air mixer of claim 6, wherein said heat shield and said radial dome form a throat area therebetween in flow communication with a fuel air mixture provided through said tubes connecting said mixer tube and said heat shield.

12. The fuel air mixer of claim 11, wherein said annular wall portion of said heat shield includes a plurality of openings formed therein adjacent said end wall so that air entering said cavity is provided into said throat area.

* * * * *